United States Patent [19]

Kametani et al.

[11] 4,115,222

[45] Sep. 19, 1978

[54] METHOD FOR ELECTROLYTIC WINNING OF LEAD

[75] Inventors: Hiroshi Kametani, Tokyo; Aiko Aoki, Chofu, both of Japan

[73] Assignee: National Research Institute For Metals, Tokyo, Japan

[21] Appl. No.: 843,282

[22] Filed: Oct. 18, 1977

[30] Foreign Application Priority Data

Oct. 25, 1976 [JP] Japan ..... 51-127162

[51] Int. Cl.[2] ..... C25C 1/18

[52] U.S. Cl. ..... 204/117

[58] Field of Search ..... 204/117

[56] References Cited

U.S. PATENT DOCUMENTS

| | | | |
|---|---|---|---|
| 3,673,061 | 6/1972 | Krvesi | 204/117 |
| 3,787,293 | 1/1974 | kametani | 204/117 |
| 4,011,146 | 3/1977 | Coltrinari et al. | 204/117 |

*Primary Examiner*—R. L. Andrews

*Attorney, Agent, or Firm*—Sherman & Shalloway

[57] ABSTRACT

A method for winning lead from a powdery material consisting of a lead sulfide concentrate or a powdery material containing lead sulfide by passing an electric current across the anode and the cathode of an electrolytic cell partitioned into an anode compartment and a cathode compartment by a diaphragm; which comprises filling the anode compartment with a suspension of the aforesaid powdery material in an aqueous solution of a water-soluble chloride, electrolytically forming the crystalline particles of lead chloride by the anodic oxidation of the suspended particles, separating and refining the crystalline particles of lead chloride from the aqueous solution of the water-soluble chloride, and filling the cathode compartment with a solution of the separated and refined crystalline particles of lead chloride dissolved in an aqueous solution of a water-soluble chloride thereby to deposit lead electrically on the cathode.

11 Claims, 1 Drawing Figure

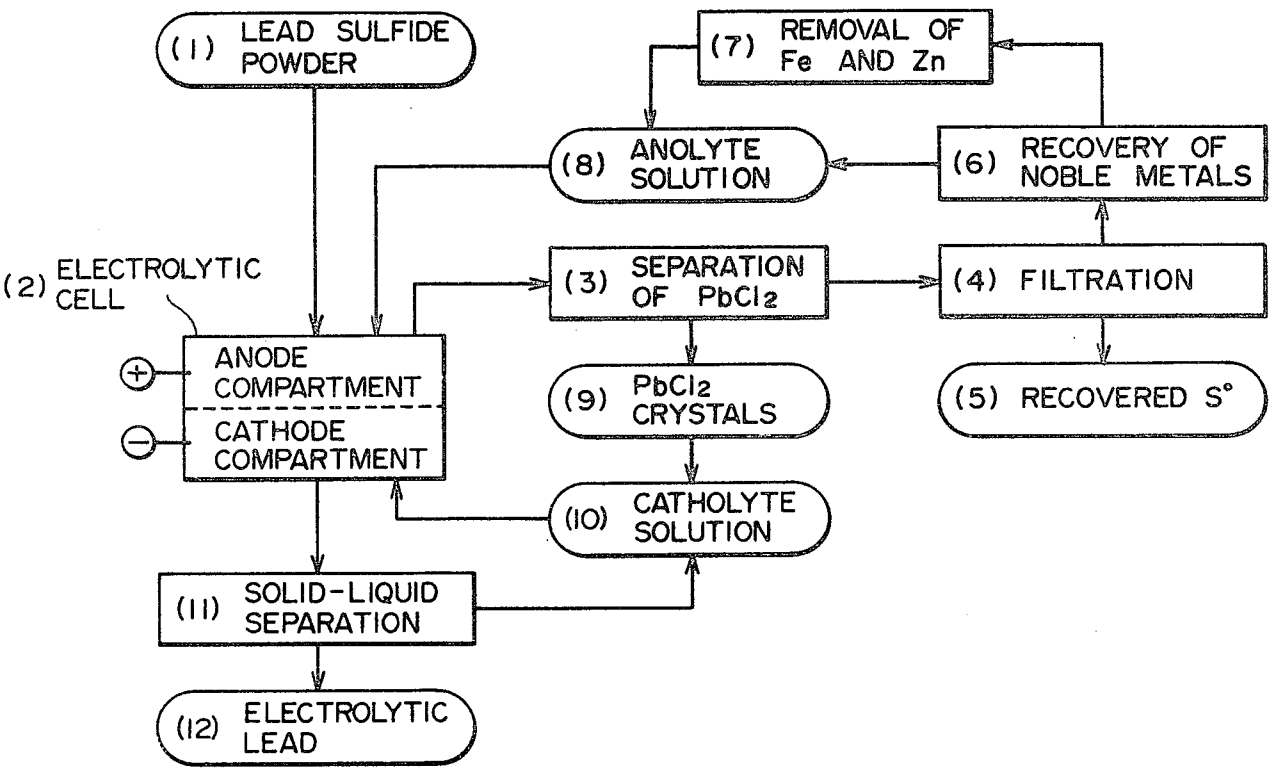
(1) LEAD SULFIDE POWDER
(2) ELECTROLYTIC CELL
ANODE COMPARTMENT
CATHODE COMPARTMENT
+
−
(3) SEPARATION OF PbCl2
(4) FILTRATION
(5) RECOVERED S°
(6) RECOVERY OF NOBLE METALS
(7) REMOVAL OF Fe AND Zn
(8) ANOLYTE SOLUTION
(9) PbCl2 CRYSTALS
(10) CATHOLYTE SOLUTION
(11) SOLID-LIQUID SEPARATION
(12) ELECTROLYTIC LEAD

METHOD FOR ELECTROLYTIC WINNING OF LEAD

This invention relates to a method for electrolytically winning lead, and more specifically, to a method for winning lead from a powder of lead sulfide by direct electrolysis.

Lead occurs principally in the form of gelena, or a sulfide of lead. The most commonly known method for winning lead from gelena comprises roasting a concentrate of lead sulfide obtained by flotation to convert it into lead oxide cinder, reducing it to obtain crude lead, and refining it by electrolysis. Frequently, lead is also included in sulfide ores of other non-ferrous metals. Since such lead is volatile during smelting in a blast furnace or the like, it is contained in a large proportion in the flue dust. Lead in the flue dust is recovered by a method similar to the method described above.

The conventional lead smelting has the defect of requiring a complicated process. Moreover, it poses a problem of environmental pollution because during the roasting and blast furnace smelting, lead tends to become a flue dust and scatter off, and at the time of electrolytic refining, a noxious fluorosilicic acid bath must be used as an electrolyte solution.

It is an object of this invention therefore to provide a method for winning lead which is free from such defects and problems.

The present inventors have found that by directly electrolyzing a powder of a lead sulfide concentrate or a powder containing lead sulfide obtained from a lead-containing flue dust or the like, the smelting process can be omitted, and by using a chloride bath as an electrolyte solution, the aforesaid defects can be remedied and the problems can be solved.

According to the present invention, there is provided an electrolytic method for winning lead from a powdery material consisting of a lead sulfide concentrate or a powdery material containing lead sulfide (to be abbreviated sometimes as a lead sulfide powder) by passing an electric current across the anode and the cathode of an electrolytic cell partitioned into an anode compartment and a cathode compartment by a disphragm; which comprises filling the anode compartment with a suspension of the aforesaid powdery material in an aqueous solution of a water-soluble chloride (anolyte solution), electrolytically forming the crystalline particles of lead chloride by anodic oxidation of the suspended particles, separating and refining the crystalline particles of the lead chloride from the aqueous solution of the water-soluble chloride, and filling the cathode compartment with a solution of the separated and refined lead chloride crystalline particles dissolved in an aqueous solution of a water-soluble chloride (catholyte solution) thereby to deposit lead electrolytically on the cathode.

The method of this invention is specifically described by reference to the accompanying drawing which is flowsheet of the process in accordance with the method of this invention.

A lead sulfide powder 1 as a raw material (for example, a powder of a concentrate of lead sulfide obtained by flotation, or a powder containing lead sulfide obtained by reducing the flue dust containing lead sulfate) is fed into an anode compartment of an electrolytic cell 2 either as such or after having been repulped with an anolyte solution. The electrolytic cell 2 is partitioned into the anode compartment and a cathode compartment by a diaphragm. An isoluble anode such as a platinum mesh, a porous graphite plate or an oxide-coated anode mesh is provided in the anode compartment, and a cathode composed of lead, titanium or stainless steel in the form of a plate, rod or mesh is provided in the cathode compartment. Many known types of electrolytic cell can be used satisfactorily in the present invention. One preferred example of the electrolytic cell is disclosed in U.S. Pat. No. 3,787,293 or Canadian Pat. No. 1,016,493.

Generally, in the prior art process, a lead sulfide powder charged into the anode compartment is stirred by a stirrer and kept in suspension in the anolyte solution. It is then anodically oxidized by electrolysis in accordance with the following formula (1).

$$PbS = Pb^{2+} + S^{o} + 2e \quad (1)$$

In this process, a solution having a high solubility for lead, such as a fluorosilicic acid solution (80–100 g Pb/l), is used as the anolyte solution. Solutions having a low solubility for lead are considered disadvantageous in regard to the amount required of the solution, polarization, current density, etc. In the present invention, on the other hand, an aqueous solution of sodium chloride or calcium chloride in which lead has a low solubility of about 3 g/l at room temperature, and about 7 g/l at 70° C. is used as the anolyte solution contrary to the general common knowledge of those skilled in the art.

Since such a solution is used as the anolyte in the method of this invention, $Pb^{2+}$ formed as a result of anodic oxidation immediately reaches the saturation concentration, and on further oxidation, solid $PbCl_2$ precipitates. The microcrystals of the precipitated $PbCl_2$ do not at all hamper the anodic oxidation of the lead sulfide powder used as a raw material. Hence, the Pb concentration in the anolyte solution reaches as high as about 100 g/l as a total Pb concentration including the precipitated $PbCl_2$ of crystalline particles. Hence, the anodic oxidation in this invention is expressed by the following formula (2).

$$PbS + 2Cl^{-} = PbCl_2 + S^{o} + 0\ 2e \quad (2)$$

The anolyte solution having suspended therein $PbCl_2$, $S^{o}$ and other materials formed at the anode compartment and having dissolved therein small amounts of valuable materials (such as Ag) or impurities (Fe, Zn, etc.) is discharged as desired from the electrolytic cell (2), and transferred to the subsequent step 3 of $PbCl_2$ separation.

In the $PbCl_2$ separating step 3, the suspended $PbCl_2$ crystals in the effluent anolyte solution are separated from the anolyte solution by a separating method based on the utilization of the differences in particle shape, specific gravity, flotation property, solubility, etc., between the $PbCl_2$ crystals and the suspended $S^{o}$ particles. Specific procedures of separation include, for example, known ore-dressing methods such as classification, shaking table concentration or flotation and known refining methods used in chemical engineering such as recrystallization or solvent extraction.

The anolyte solution left after the separation of the crystalline $PbCl_2$, namely the anolyte solution containing $S^{o}$ particles as a suspended matter, is then filtered together with other insoluble particles such as unreacted PbS and gangues in the filtering step 4, after which the filtration residue is submitted to an $S^o$ recovering step 5.

Noble metals such as Ag contained in the lead sulfide concentrate dissolves in the anolyte solution since they are soluble in the chloride solution of a high concentration. Thus, the filtrate formed in the filtration step 4 is transferred to a noble metal recovering step 6, and noble metals are separated and recovered from the solution by a known method such as a replacing method, a sulfide precipitation method, an electrolytic extraction method or a solvent extraction method.

The solution left after the recovery of noble metals is recycled for reuse as the anolyte solution 8. If required, a part of the solution is treated by a known method such as hydrolysis in a step 7 of removing Fe and Zn in order to remove Fe and Zn which have dissolved out from the raw material and accumulated. The treated solution is then recycled for reuse as the anolyte solution 8.

The $PbCl_2$ crystals 9 separated and refined in the $PbCl_2$ separating step are added to and dissolved in a chloride solution having almost the same composition as the anolyte solution. The resulting solution as a catholyte solution 10 is sent to the cathode compartment of the electrolytic cell 2.

In the cathode compartment, metallic $Pb^o$ deposits by a cathodic reaction shown by the following formula (3).

$$Pb^{2+} + 2e = Pb^o \quad (3)$$

Various methods are available in recovering the deposited lead, and the electrolysis is possible with any of these methods. These methods include (a) a method which involves depositing lead on a plate-like cathode (the most general method); (b) a "powder electrolyzing method" which comprises depositing lead in a dendritic form or in the form of a small plate on a cathode in the form of a plate, rod or mesh, and removing it periodically from the cathode; and (c) a "suspension electrolytic method" which comprises charging speed particles of lead into a cathode compartment, and performing electrolysis while suspending the seed particles in the catholyte solution by such a method as stirring, vibration, oscillation, or fluidized bed formation, thereby to deposit lead electrolytically on the surface of the seed particles of lead in contact with the cathode and to grow the lead particles. The principle of method (c) is described in the above-cited U.S. patent or Canadian patent.

Lead deposited by these methods is recovered as electrolytic lead 12 in a solid-liquid separation step 11. On the other hand, the solution left after the recovery of electrolytic lead is recycled for reuse as catholyte solution 10.

The concentration of lead in the catholyte solution decreases as lead precipitates in the cathode compartment. Electrolysis is continued while adding the catholyte solution having dissolved therein the $PbCl_2$ crystals 9 in order to replenish lead. In the case of the suspension electrolyzing method (c), it is possible to feed $PbCl_2$ crystals directly into the cathode compartment.

An anion or cation exchange membrane is used as a diaphragm for the electrolytic cell 2. When an anion exchange membrane is used, $Cl^-$ diffuses from the cathode compartment to the anode compartment. Hence, the entire reaction of lead deposition at the cathode is expressed by the following formula.

$$PbCl_2 + 2e = Pb^o + 2Cl^- \quad (4)$$

Two $Cl^-$ ions freed in accordance with formula (4) migrate from the cathode compartment to the anode compartment, and is consumed by the electrolytic reaction of formula (2) to form $PbCl_2$. On the other hand, when a cation exchange membrane is used, $H^+$ diffuses from the anode compartment to the cathode compartment. It is necessary to neutralize the catholyte solution and to return $Cl^-$ present in the catholyte solution to the anolyte solution.

The essence of the present invention is that a lead sulfide powder is anodically oxidized using a chloride solution having a low solubility for lead and the resulting $PbCl_2$ is suspended in the form of crystalline particles in the anolyte solution thereby to increase the concentration of lead in the entire suspension, and that the resulting $PbCl_2$ crystalline particles are separated from the anolyte solution and then added to the catholyte solution. The anodic oxidation is the most important feature of the present invention, and will be described in greater detail hereinbelow.

Desirably, the starting lead sulfide powder has a particle diameter of not greater than 100 mesh. Since concentrates generally have a particle diameter of not greater than 100 mesh, grinding is not particularly required. The important point in regard to the composition of the anolyte is the concentration of $Cl^-$. It is desirable that the $Cl^-$ concentration be usually 1 to 6 moles/l, especially 3 moles/l. NaCl or $CaCl_2$ is suitable as the water-soluble chloride, but other stable chlorides may also be used. Addition of an Fe salt to the anolyte solution is effective for increasing the stability of electrolysis and the rate of anodic oxidation (i.e., the cell current). However, since the raw material normally contains Fe as an impurity, it is not particularly necessary to add Fe. Too high concentrations of Fe are not preferred from the viewpoint of treating the solution, and the Fe concentration is desirably maintained at 2 to 20 g/l. The temperature of the solution in the electrolytic cell is room temperature or a higher temperature, and is not particularly limited. Desirably, it is 40° to 80° C. The pH of the anolyte solution is not relevant to the rate of anodic oxidation if it is below the pH at which $Fe^{3+}$ can be hydrolyzed. If the pH is too low, a vapor of HCl is formed, or a hydrogen sulfide gas is evolved by the dissolving of PbS. Hence, the pH of the anolyte solution is desirably about 1.

The potential of an anodic suspension containing the charged material and crystalline $PbCl_2$ measured by using a platinum electrode and a reference electrode is important in the electrolytic operation. When the potential of the anodic suspension is lower than about 0.1 V in the case of using a saturated calomel electrode as the reference electrode, hydrogen sulfide is sometimes generated owing to the simple dissolution of PbS, and normal electrolysis cannot be continued. On the other hand, when the electric potential exceeds about 0.5 V, the current efficiency decreases owing to the generation of gases at the anode. The desirable potential for the continuance of normal electrolysis is usually within the range of 0.26 V and 0.45 V although it somewhat varies according to the temperature of the cell and the concentration of Fe. This potential can be utilized as a measure for the feeding of the raw material. This means that electrolysis can be performed continuously in a stable condition by adjusting the rate of feeding the raw material so that the prescribed potential is maintained within the above-specified range. In this case, the rate of feeding the raw material is determined mainly by the current which passes through the electrolytic cell.

Since the raw material to be electrolyzed by the method of this invention is a powder and is being stirred, the current that can be passed through the electrolytic cell is very high. As will be shown later by Examples, a high current density of, say, 20 $A/dm^2$ can be obtained at the diaphragm.

As described hereinabove, the method of electrolytic winning of lead in accordance with this invention uses a chloride solution, which has not been used heretofore because of its low solubility for lead, as an anolyte solution and performs the anodic oxidation of a starting powdery lead sulfide suspended in the anolyte solution. Accordingly, the roasting step and blast furnace smelting step in the conventional process can be omitted, and the process now in use can be greatly simplified. Furthermore, a high current density can be used, and the efficiency of the electrolytic cell increases. The method also makes it possible to control environmental pollution.

The following Examples specifically illustrate the present invention.

EXAMPLE 1

A cylindrical electrolytic cell made of Bakelite and having an inside diameter of 14 cm was divided into two compartments by means of a cation exchange membrane which was provided horizontally. The anode compartment above the diaphragm (height 10 cm) was fitted with a platinum mesh anode, a stirrer, a lead concentrate feeder, a thermometer, a glass electrode, a platinum electrode and two saturated calomel electrodes. An inlet and outlet for the catholyte solution were provided in the cathode compartment below the diaphragm (height 2.5 cm). The bottom of the cathode compartment was built with a titanium plate which functioned as a cathode. The electrolytic cell was heated by an external heater to maintain the temperature of the electrolyte solution at 85° to 94° C.

Using 1.6 liters of an anolyte solution containing 3 moles/l of NaCl, 15 g/l of $Fe^{2+}$ and 5 g/l of $Pb^{2+}$ and having a pH of −0.45, conditioning electrolysis was performed for 30 minutes at a cell current of 5 A, for 10 minutes at a cell current of 10 A and for 10 minutes at a cell current of 20 A, and then electrolysis was performed for 1 hour at 30 A (current density about 20 $A/dm^2$). A lead concentrate (65.6% Pb) in a total amount of 200 g was charged while adjusting the rate of feeding the lead concentrate so as to maintain the potential of the anolyte solution at 0.38 V during the electrolysis. From the anolyte solution after the electrolysis, 159.6 g of $PbCl_2$ was recovered by recrystallization. This shows that the concentration of the lead concentrate suspended in the anolyte solution was about 100 g/l. The current efficiency at the anode was 82%.

In the meantime, a catholyte solution containing 3 moles/l of NaCl and about 12 g/l of $Pb^{2+}$ was circulated through the cathode compartment while adding $PbCl_2$ in a total amount of 191 g to the catholyte solution. After the electrolysis, 150.2 g of lead powder was obtained. At this time, the current efficiency at the cathode was 103.3%.

Since a cation exchange membrane was used as the diaphragm in this electrolytic process, the pH of the cathode decreased from −0.32 before the electrolysis to −0.66 after the electrolysis.

EXAMPLE 2

An electrolytic cell having the same size as that used in Example 1 was used, and an anion exchange membrane was used as a diaphragm. Electrolysis was performed at a temperature of 60° to 70° C. for 30 minutes at a cell current of 5 A, for 30 minutes at a cell current of 10 A, and for 1 hour and 26 minutes at a cell current of 20 A. The potential of the anolyte solution was maintained at 0.38 V, and a lead concentrate was fed in a total amount of 200 g during the electrolysis. From the anolyte solution after the electrolysis, 166.2 g of $PbCl_2$ was obtained by recrystallization. At the cathode, 142.9 g of Pb deposited.

The pH values of the catholytesolution and the anolyte solution were constant within the range of from 0.7 to 0.5, and from −0.46 to −0.48, respectively. The fe concentration in the anolyte solution was 9.4 g/l before the electrolysis and 11.3 g/l after the electrolysis.

EXAMPLE 3

Under the same conditions as in Example 2, the pH of the anolyte solution was increased to 0.45, and electrolysis was performed for 30 minutes at a cell current of 5 A, for 20 minutes at a cell current of 10 A, and for 1.5 hours at a cell current of 20 A. The pH values of the anolyte solution and the catholyte solution during the electrolysis were substantially constant within the range of from 0.45 to 0.48, and from 0.70 to 0.65, respectively.

The anolyte solution containing $PbCl_2$ crystals in the suspended state was subjected to a testing shaking table (15 × 30 cm) and the table was operated at 200 cycles/minute with an amplitude of 1 cm. Thus, 147.5 g of the $PbCl_2$ crystals were separated.

A small amount of $PbCl_2$ remaining in the suspension left after the separation of the $PbCl_2$ crystals was removed by recrystallization. The residue was filtered to afford 51.7 g of a residue. The residue contained 33% of $S^o$.

What we claim is:

1. A method for winning lead from a powdery material consisting of a lead sulfide concentrate or a powdery material containing lead sulfide by passing an electric current across the anode and the cathode of an electrolytic cell partitioned into an anode compartment and a cathode compartment by a diaphragm; which comprises filling the anode compartment with a suspension of the aforesaid powdery material in an aqueous solution of a water-soluble chloride, electrolytically forming the crystalline particles of lead chloride by the anodic oxidation of the suspended particles, separating and refining the crystalline particles of lead chloride from the aqueous solution of the water-soluble chloride, and filling the cathode compartment with a solution of the separated and refined crystalline particles of lead chloride dissolved in an aqueous solution of a water-soluble chloride thereby to deposit lead electrolytically on the cathode.

2. The method of claim 1 wherein sodium chloride or calcium chloride is used as the water-soluble chloride.

3. The method of claim 1 wherein the separation and refining of the crystalline particles of lead chloride formed by electrolysis are carried out by withdrawing them from the anode compartment together with the aqueous solution of the water-soluble chloride, and separating the particles from the aqueous solution by a known ore-dressing method and a known refining method used in chemical engineering.

4. The method of claim 1 wherein the aqueous solution left after the separation of the crystalline particles of lead chloride is recycled to the anodecompartment after removing valuable materials and impurities from it.

5. The method of claim 1 wherein the diaphragm is an anion exchange membrane.

6. A method for winning lead from a powdery material consisting of a lead sulfide concentrate or a powdery material containing lead sulfide by passing an electric current across the anode and the cathode of an electrolytic cell partitioned into an anode compartment and a cathode compartment by a diaphragm, which comprises filling the anode compartment with a suspension of the aforesaid powdery material in an aqueous solution of a water-soluble chloride, electrolytically forming the crystalline particles of lead chloride by the anodic oxidation of the suspended particles, separating and refining the crystalline particles of lead chloride from the aqueous solution of the water-soluble chloride, filling the cathode compartment with a solution of the separated and refined crystalline particles of lead chloride dissolved in an aqueous solution of a water-soluble chloride, and suspending lead seed particles in the solution by stirring, thereby to deposit lead electrolytically on the surface of the lead seed particles which are in contact with the cathode.

7. The method of claim 6 wherein sodium chloride or calcium chloride is used as the water-soluble chloride.

8. The method of claim 6 wherein the separation and refining of the crystalline particles of lead chloride formed by electrolysis are carried out by withdrawing them from the anode compartment together with the aqueous solution of the water-soluble chloride, and separating the particles from the aqueous solution by a known ore-dressing method and a known refining method used in chemical engineering.

9. The method of claim 6 wherein the aqueous solution left after the separation of the crystalline particles of lead chloride is recycled to the anode compartment after removing valuable materials and impurities from it.

10. The method of claim 6 wherein the separated and refined crystalline particles of lead chloride are directly fed into the cathode compartment.

11. The method of claim 6 wherein the diaphragm is an anion exchange membrane.

* * * * *